US008495961B2

(12) United States Patent
Kiolbasa

(10) Patent No.: US 8,495,961 B2
(45) Date of Patent: Jul. 30, 2013

(54) SHIPPING SYSTEM AND METHOD OF USE

(76) Inventor: Charles G. Kiolbasa, Burr Ridge, IL (US)

( * ) Notice: Subject to any disclaimer, the term of this patent is extended or adjusted under 35 U.S.C. 154(b) by 0 days.

(21) Appl. No.: 13/271,921

(22) Filed: Oct. 12, 2011

(65) Prior Publication Data

US 2012/0234213 A1 Sep. 20, 2012

Related U.S. Application Data

(63) Continuation-in-part of application No. 12/037,655, filed on Feb. 26, 2008, now abandoned.

(60) Provisional application No. 60/946,435, filed on Jun. 27, 2007, provisional application No. 61/392,330, filed on Oct. 12, 2010.

(51) Int. Cl.
*B65D 19/00* (2006.01)

(52) U.S. Cl.
USPC ..... 108/53.5

(58) Field of Classification Search
USPC ..... 108/54.1, 53.1, 53.3, 53.5, 55.1, 108/55.3, 55.5, 51.11; 206/600
See application file for complete search history.

(56) References Cited

U.S. PATENT DOCUMENTS

| | | | | |
|---|---|---|---|---|
| 3,854,544 | A * | 12/1974 | Kolchev | 180/14.1 |
| 4,029,023 | A * | 6/1977 | Rosewicz et al. | 108/57.28 |
| 5,269,414 | A * | 12/1993 | D'Hollander | 206/600 |
| 5,791,262 | A * | 8/1998 | Knight et al. | 108/57.25 |
| 6,305,301 | B1 * | 10/2001 | Piper et al. | 108/57.25 |
| 2005/0188901 | A1 * | 9/2005 | Arai et al. | 108/53.1 |

* cited by examiner

*Primary Examiner* — Jose V Chen
*Assistant Examiner* — Matthew Ing
(74) *Attorney, Agent, or Firm* — Banner & Witcoff, Ltd.

(57) ABSTRACT

An improved shipping system includes a base deck section. The system further includes an upper-tier deck section, that moves between a position atop the base deck section through a variety of positions, including positions that put the upper section out of the way of loading and unloading any load on the base deck section. Cartons may be atop both the base deck section and the upper-tier deck section, for shipments, with the upper-tier deck section in the raised configuration. When emptied, the shipping system may be returned with its upper-tier deck section moved down to a position atop the base deck section, and the shipping system stacked upon a similar improved shipping system. Shipping efficiency is increased as much as twenty percent and perhaps more. All components are steel, and may also be plastic, wood and the like.

19 Claims, 10 Drawing Sheets

Figure 10
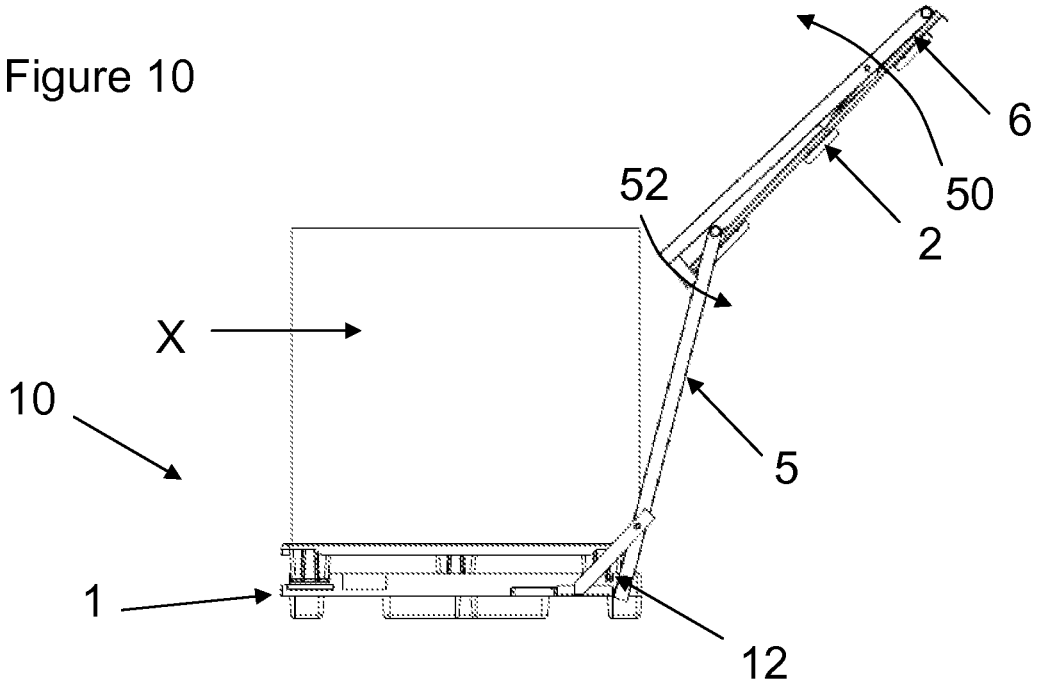
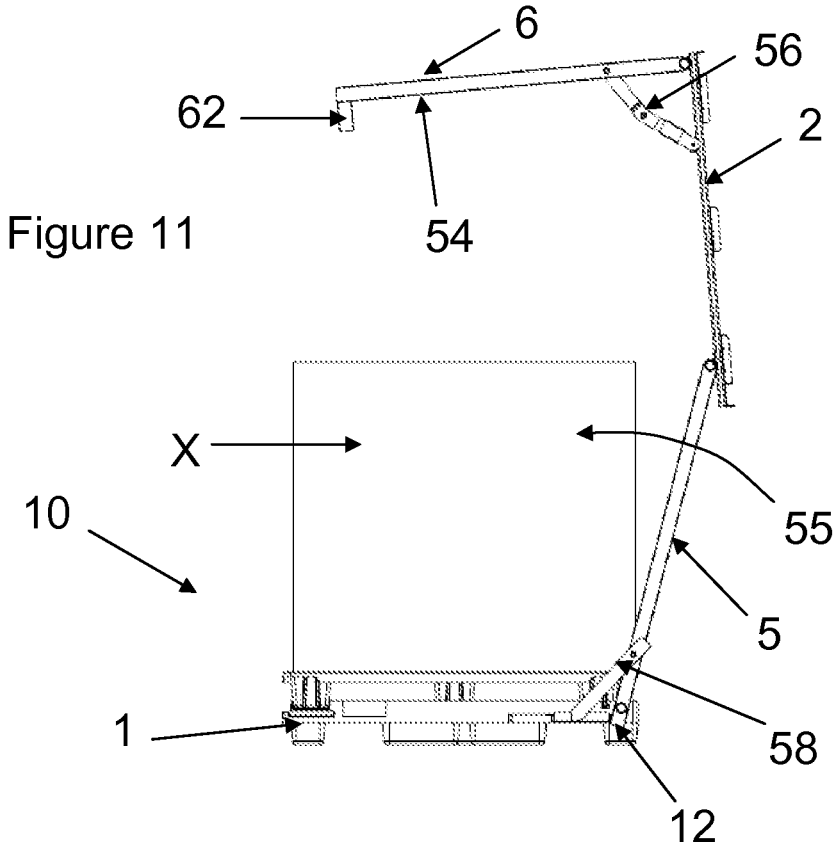
Figure 11

Figure 16
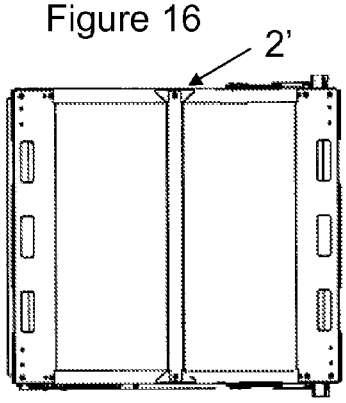
Figure 13
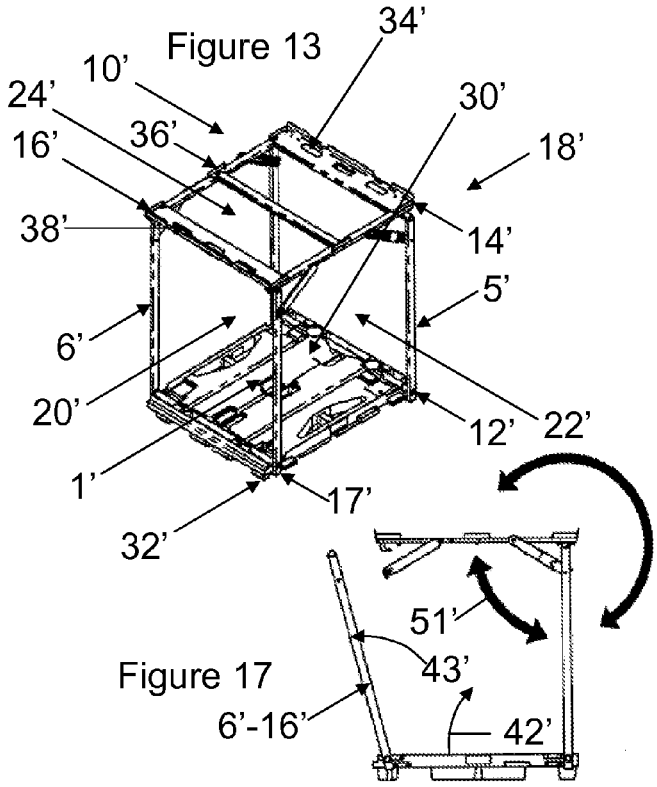
Figure 17
Figure 15
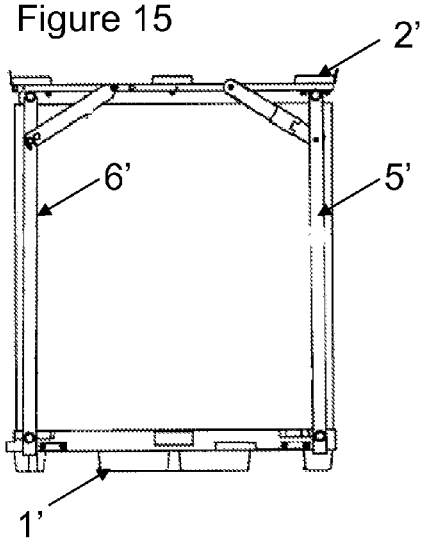
Figure 14
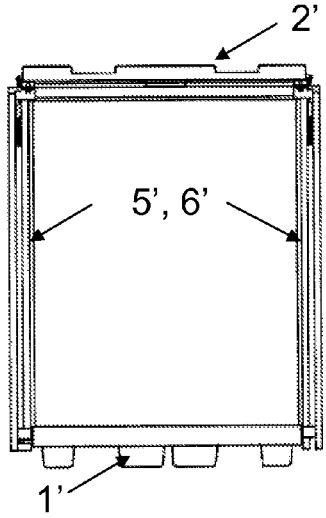

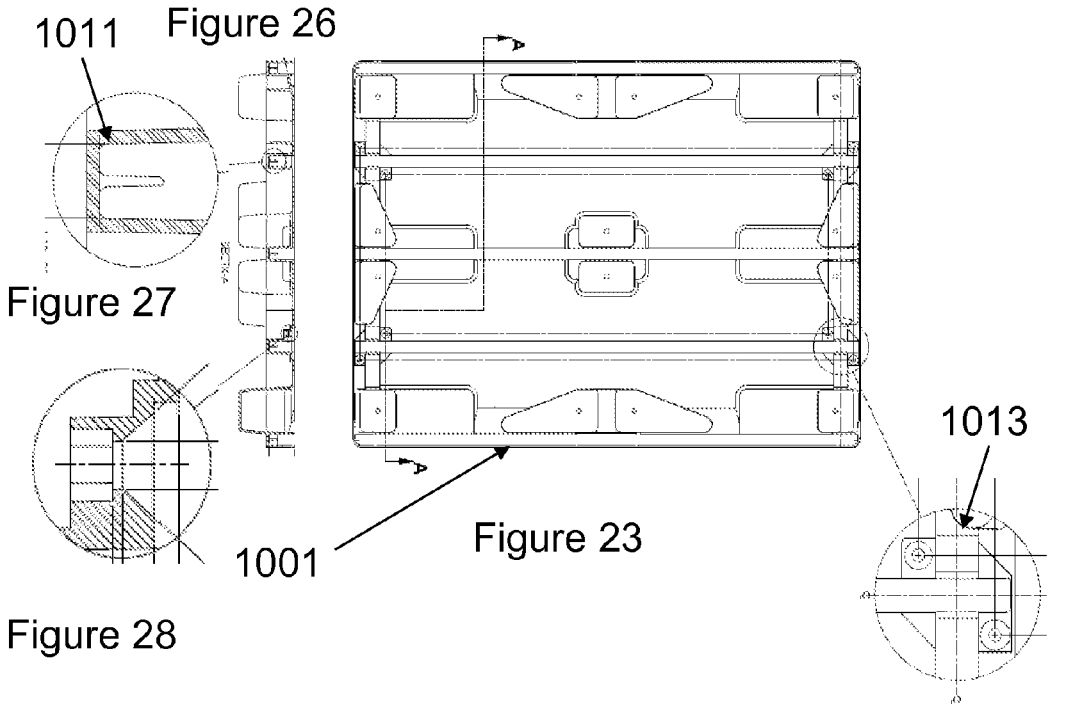
1011
Figure 26
Figure 27
Figure 28
1001
Figure 23
1013
Figure 29
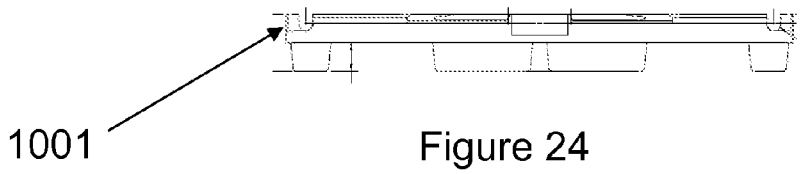
1001
Figure 24
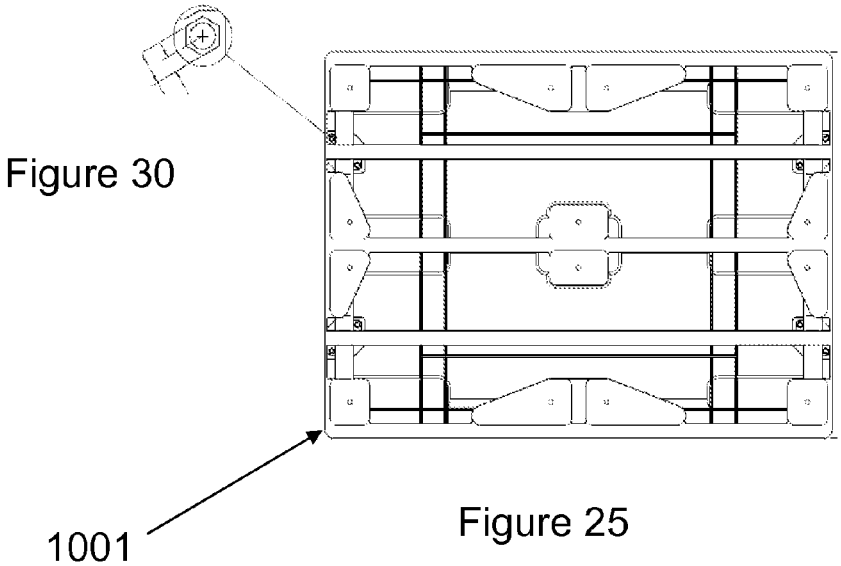
Figure 30
1001
Figure 25

SHIPPING SYSTEM AND METHOD OF USE

PRIORITY INFORMATION

This application is a continuation-in-part of U.S. Non-Provisional patent application Ser. No. 12/037,655 filed Feb. 26, 2008, now abandoned, which claims the benefit of priority of U.S. Provisional Application No. 60/946,435, filed Jun. 27, 2007, and also is a non-provisional of U.S. Provisional Application No. 61/392,330, filed Oct. 12, 2010, the contents of which are incorporated by reference in their entirety.

FIELD OF INVENTION

This invention relates to the field of shipping packages and objects, to an improved shipping system for shipping such packages and objects, and to the methods of use of such systems and also pallets.

BACKGROUND

In the past, pallets have been used for shipping packages and objects, which have been typically constructed of rough wood. Some have been used that have been presswood, plastic, and aluminum. Wood pallets typically allow for forklift movement of the pallets and their loads. Some allow forklift access from two opposed sides, and are said to provide 2-way forklift access. Others provide 4-way forklift access. Some have been made "nestable," or able to be nested one on top another for ease of stacking Some have integrated sidewalls to become containers, and have been collapsible and stackable. Some are made specifically for 55 gallon drums, others specifically for sheetfed press runs, rolls of film, paper and the like, and still others for television display panels. Some are less sturdy, for limited use, and others more sturdy, for extended use. Numerous remain wood pallets of conventional construction.

With wood pallets, and even the ones more "high tech," some shipments suffer greatly with shipment damage. This is especially true with many goods packaged in paperboard and small flute corrugated boxes and cartons, often called folding and folded cartons. The goods in such cartons include many consumer products, from medicines and pharmaceuticals, to foods such as breakfast cereals, pasta and chocolates, through toys, consumer electronics and automotive parts. In these boxes, many products have been damaged and their boxes crushed from forklift damage and their own weight when overstacked. As a result, needs have existed over years and decades for shipping systems that provide improved transportation for more fragile loads such as paperboard loads. The needs include ease of loading and unloading, as well as greater heights of loads without self imposed crushing, and the like.

The improved shipping system of this invention was specifically developed to minimize or potentially eliminate crushing, bowing and other damage issues. Increasing the volume of the trailer occupied without fear of having damaged or crushed products is an added benefit that can result in significant freight cost reductions.

SUMMARY

In a first embodiment, an improved shipping system includes a base deck section. The system further includes an upper-tier deck section, that moves between a position atop the base deck section through a variety of positions, including positions that put the upper section out of the way of loading and unloading any load on the base deck section. Loaded pallets may be atop both the base deck section and the upper-tier deck section, for shipments, with the upper-tier deck section in the raised configuration. When emptied, the system may be returned with its upper-tier deck section moved down to a position atop the base deck section, and the system stacked upon a similar improved system. Shipping efficiency is increased as much as twenty percent and perhaps more. All components are steel, and may also be plastic, wood and the like.

To provide the movement of the upper-tier deck section, and support it in the position shown, several legs are provided on each end, extending between the base deck section and the upper-tier deck section. The legs are detachable from the upper-tier deck section and/or the base deck section, and may hook into catches. The legs may lie against the base deck sections. The legs may be hinged at their ends.

As described, the upper-tier deck sections provide space between the base deck sections and the upper-tier deck sections for a loaded pallet stacked on and supported by the base deck sections. The upper-tier deck sections also provide for loaded pallets supported by and stacked on the upper-tier deck sections. Shipping costs may be reduced as trucks may be better filled with the systems filled with pallets. The shipping system disclosed may be rented and used multiple times, further improving economy.

In another embodiment, an improved shipping system includes a base deck section similar to the first embodiment. The system further includes an upper-tier deck section, similar to the first embodiment. The upper-tier deck section moves again between a position atop the base deck section through a variety of positions, with less concern for positions that put the upper section out of the way of loading and unloading loads on the base deck section. Again, loaded pallets may be atop both the base deck section and the upper-tier deck section, for shipments, with the upper-tier deck section in the raised configuration. When emptied, the system may again be returned with its upper-tier deck section moved down to a position atop the base deck section, with less concern for stacking Shipping efficiency is increased as much as twenty percent and perhaps more. All components are steel, and may also be plastic, wood and the like.

With the second embodiment, to provide the movement of the upper-tier deck section, and support it in position, several legs are also provided on each end, extending between the base deck section and the upper-tier deck section. On one side, the legs are detachable from the upper-tier deck section. The legs may lie against the base deck sections. The legs may be hinged at their ends.

In a third embodiment, an improved shipping system still includes a base deck section. The system further continues to include an upper-tier deck section, as well. In the third embodiment, the upper-tier deck section is consistently in a position atop the base deck section, and movable through a variety of heights relative to the base deck section. Loaded pallets may be atop both the base deck section and the upper-tier deck section, for shipments, with the upper-tier deck section in the raised configuration and at a height suitable for the height of the loaded pallet put on the base deck section. When emptied, the system may be returned with its upper-tier deck section moved down to a position nearest the base deck section. Stacking is possible, although the first and second embodiments stack more closely together when stacked. Shipping efficiency is continued to be increased as much as twenty percent and perhaps more. All components are steel, and may also be plastic, wood and the like.

To provide the movement of the upper-tier deck section, and support it in position, several legs are still provided on each end, extending between the base deck section and the upper-tier deck section. The legs are extendible and retractable between a variety of positions of the upper-tier deck section relative to the base deck section, and may be pinned to chosen lengths of extension and retraction. The legs stand perpendicular to the base deck sections. The legs are fixed to the based deck sections and the upper-tier deck sections.

BRIEF DESCRIPTION OF THE DRAWINGS

The drawings that accompany this description include several figures, each described as follows:

FIGS. 7 through 12 are views in a series of the erection and then, in reverse, collapse, of the shipping system of FIG. 1 from collapsed configuration, to a folded back and load-ready configuration for loading and/or unloading the base deck section through the raising of the upper-tier for an upper-tier raised configuration for shipping, loading and/or unloading the upper-tier. The demonstrated movements are accompanied by persons loading and unloading the shipping system, as may be desired.

FIGS. 13 through 17 are, respectively, a perspective, an end, a side, a top, and an erection view of a second preferred embodiment of invention.

FIGS. 19 and 20 include erection images of the third preferred embodiment of invention.

FIGS. 22 through 30 are, respectively, a perspective, a top plan view, a side view, a bottom plan view, a cross-section view (FIG. 26, along line A-A of FIG. 23), and detail views of a preferred base deck section.

DETAILED DESCRIPTION

Figure 1:
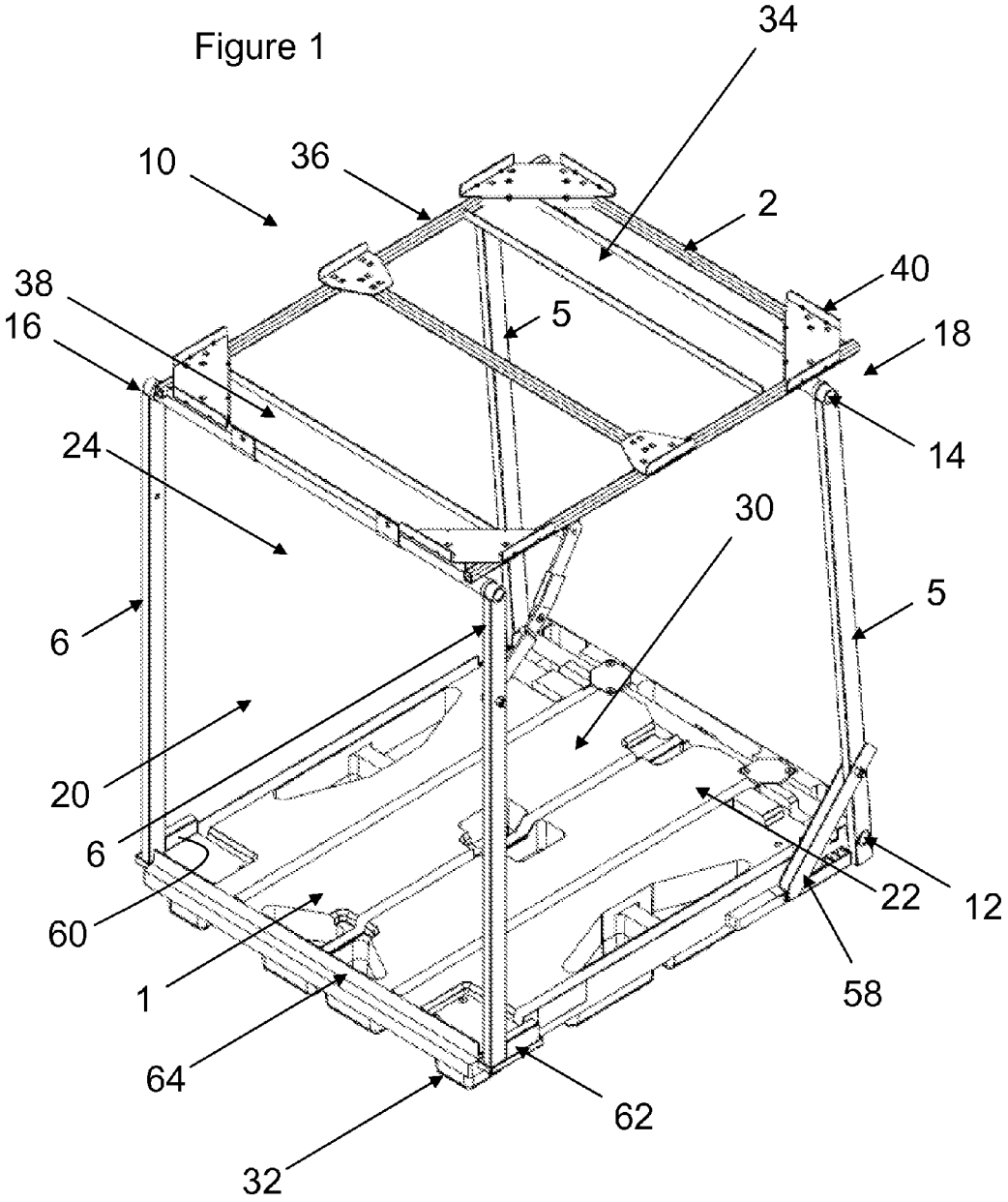
FIG. 1 is a perspective view from above a corner of the upper-tier deck section of a first preferred embodiment of the invention.

Referring to FIG. 1, a first preferred embodiment of the invention is a shipping system 10. Scanning across FIGS. 1 through 12, the shipping system may be in an upper-tier raised configuration as in FIGS. 1, 3-6, and 12, an upper-tier lowered, "stowed" or collapsed configuration as in FIGS. 2 and 7, and a variety of configurations between these configurations, as in FIGS. 8-11. In the raised configuration, the shipping system 10 is typically in outgoing shipping condition, with a load X on the base or lower deck section, and a load (not shown) on the upper-tier deck section 2. In the collapsed configuration, the shipping system 10 is typically in inbound or return shipping condition, stacked with other similar shipping systems 10, and with no load on the pallet sections. The shipping system 10, consistently, may be loaded, lifted by forklift (not shown), placed on a vehicle (not shown), transported, stored as needed, unloaded, collapsed, and returned for further shipment. Of course, the shipping system may be shipped loaded or unloaded without necessity of immediate return to place of origin after first shipment.

In addition to the base deck section 1 and the upper-tier section 2, the shipping system 10 comprises three pivot rods 12, 14, 16 and legs 5, 6 in pairs, at each end of pivot rods 12, 14, 16. The rods 12, 14, 16 are generally parallel to each other, and spaced about the shipping system 10, at one edge of the base deck section 1 (rod 12), just below the plane of the upper-tier deck section 2 and generally above the rod 12 (rod 14), and just below the plane of the upper-tier deck section 2 and opposite the rod 12 (rod 16). The pivot rods 12, 14, 16 provide for pivoting of the legs 5, upper-tier deck section 2, and legs 6, as will be explained.

In the raised or erected configuration of FIG. 1, the shipping system 10 generally defines a cube, unlike conventional pallets which generally always define a plane. The cube of the shipping system 10 wraps a load X, as in FIG. 12, whereas a conventional pallet simply underlies a load. Referring to FIG. 1 for elements 1, 2, 5 and 6, and to FIG. 12 for load X, the shipping system 10 wraps a load X in that the base deck section 1 underlies the load X, legs 5 lie along one side of the load X, upper-tier deck section 2 overlies the load X, and legs 6 lie along another side of the load X opposite the legs 5. Legs 5 and pivot rods 12, 14 define one end face 18 of the system cube. Legs 6 and pivot 16, along with the upper outer edge of the base deck section 1 define a second, opposite end face 20. Similar side faces 22, 24, are formed by the structures of the shipping system 10, as are upper and lower faces formed by the structures 1 and 2.

The base deck section 1 is substantially square, and formed in the third dimension, top and bottom, to form a sectioned load supporting deck 30. On the top face the shipping system is sectioned by indentations. On the bottom face the base deck section is additionally formed to have several feet such as foot 32 for supporting the whole of the pallet 10 and providing four sided forklift access. The base deck section 1 is plastic, with horizontal steel rod supports incorporated.

Figure 12:
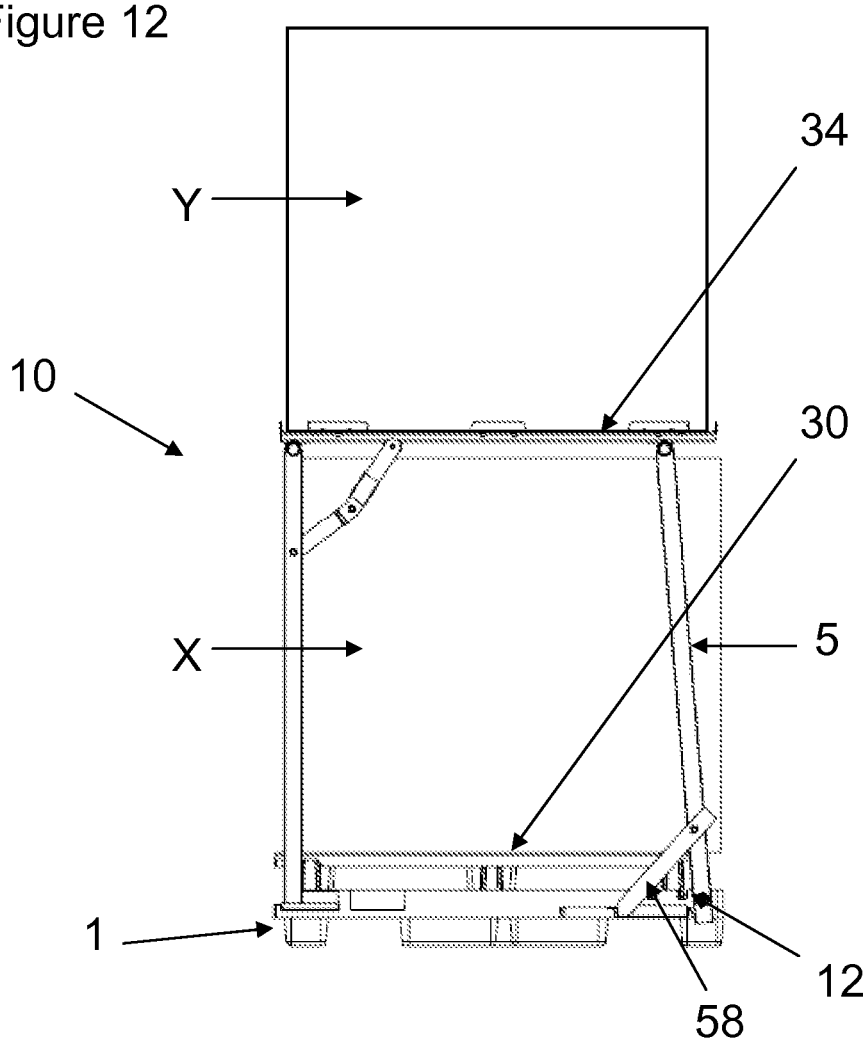
Figure 21:
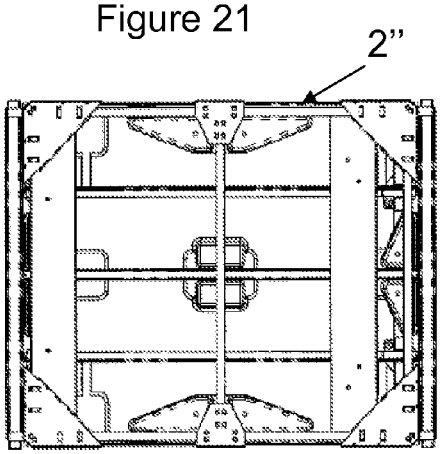
FIGS. 18 through 21 are, respectively, a perspective, an end, a side, and a top view of a third preferred embodiment of invention.

The upper-tier deck section 2 defines a second load supporting deck 34 for another load Y, seen in phantom in FIG. 12. The second deck 34 is formed by crossrails and plates such as rail 36 and plate 38, as well as corner and side gussets such as corner gusset 40. The gussets include lips along the outside edges for the second deck 34, for contacting and holding a load Y against side to side and end to end slippage.

Figure 7:
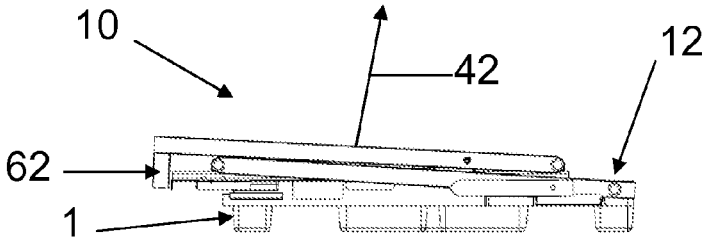
Figure 8:
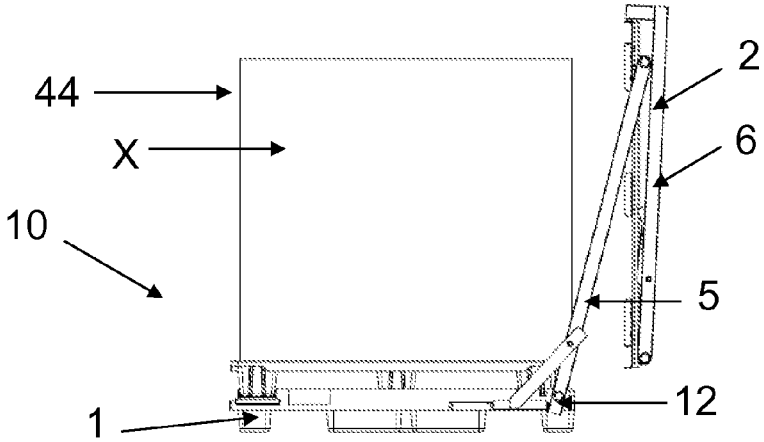
Figure 9:
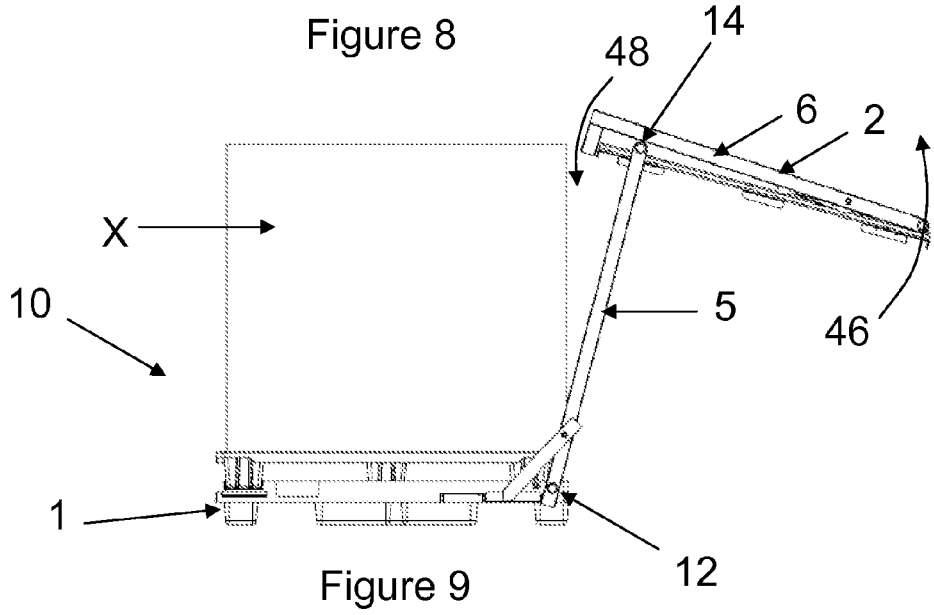

Referring to FIGS. 7-12, shipping systems 10 may be manipulated by hand from the collapsed configuration and condition of FIG. 7 through the loaded configuration and condition of FIG. 12. First, the collapsed shipping system 10 may have the upper-tier moved and pivoted in the direction of arrow 42 from the configuration of FIG. 7, around the pivot 12, to the configuration of FIG. 8. The configuration and condition is one of being folded back and load-ready, for receiving the load X. The load X may be assembled of cartons by hand on a pallet on the shipping system 10, or moved in by forklift in the direction of arrow 44. With the load in place, the upper-tier deck section 2 may be swung in the directions of the arrows 46, 48 in FIG. 9, to move toward the position of FIG. 10. Pivoting continues in the direction of arrows 50, 52, to begin to rotate the upper-tier deck section 2 over the load X. The legs 6, previously tucked alongside the upper-tier deck section 2, are then pivoted away from the upper-tier deck section 2, in the direction of arrow 54. The legs 5 are also pivoted, in the direction of arrow 55. As the legs 6 extend away from the upper-tier deck section 2, an over center latch 56 at one side 22 opens and is latched, to keep the legs 6 fixed in relation to the upper-tier deck section 2. A pivotal stop 58, at the base of one leg 5, slides forward along a slide surface, to a bumper, and blocked against the bumper, stops rotation of the legs 5 at a desired location, as in FIGS. 1 and 12. Rotation of the upper-tier deck section 2 and legs 6 continues around the load X.

At the completion of erection of the shipping system 10, and as shown in FIGS. 1 and 12, the legs 5,6 and upper-tier deck section 2 encircle the load X over the base deck section 1. The legs 5, 6 and upper-tier deck section 2 protect the load X, as well. The legs 5 angle inward over the load X, in an off-vertical position. The legs 6 are essentially upright, i.e., vertical. Two stops pads 60, 62 as seen in FIG. 1 at the far ends of legs 6 from the upper-tier deck section 2, rest on the base deck section 1. They extend adjacent an extended lower load retention lip 64 of the base deck section 1.

A load X and if desired a load Y may then be transported and offloaded from the shipping system 10.

Figure 2:
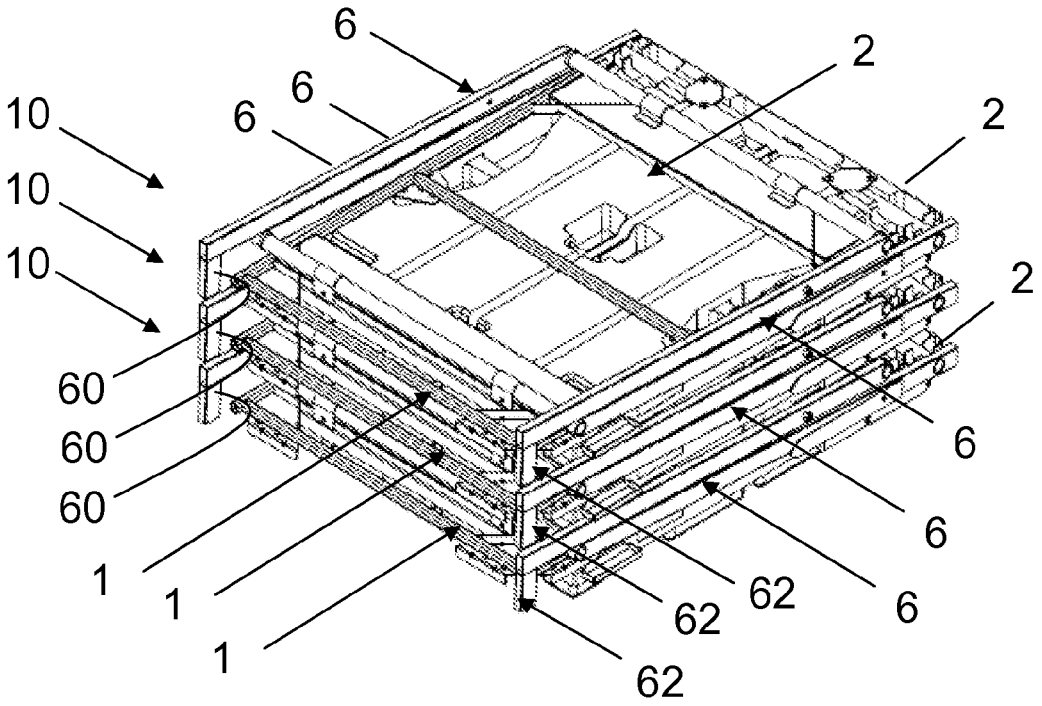
FIG. 2 is a perspective view from the same location, with the shipping system of FIG. 1 collapsed and several shipping systems, similarly collapsed and placed on the shipping system of FIG. 1, for shipment of the group of shipping systems, as for example during the return of empty shipping systems to the place of the originating shipment.
Figure 3:
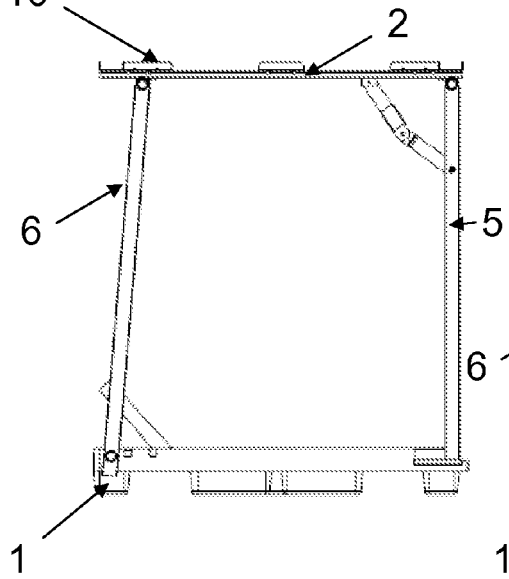
FIGS. 3, 4, 5, and 6 are, respectively, end, side, top and bottom plan views of the shipping system of FIG. 1, in the condition of FIG. 1.
Figure 4:
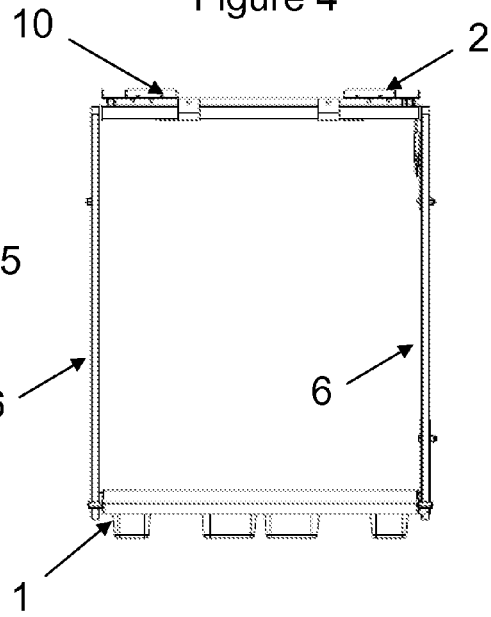
Figure 5:
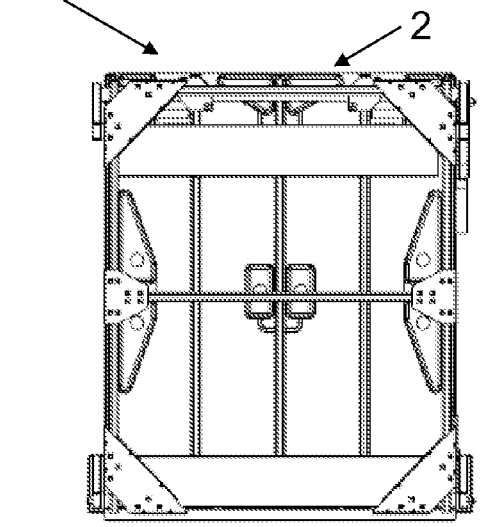
Figure 6:
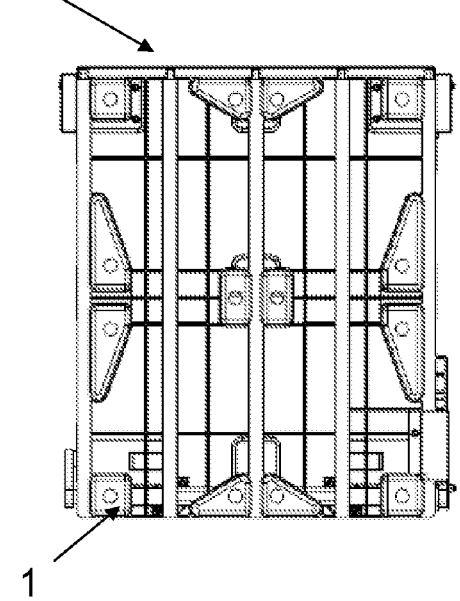

As will be noticed in FIG. 2, when the loads are removed, numerous shipping systems 10 may be stacked. The lowest-most shipping system 10 constitutes a pallet for all the above-stacked shipping systems 10, such that the stack may be lifted and transported as a load itself. For stacking, the shipping system 10 has pivot stop 58 lifted and the legs 5 dropped on the base deck section 1, rotating about the pivot rod 14. The upper-tier deck section 2 is folded over the legs 5 about the same pivot rod, and brought to rest upside down, i.e., inverted, over the base deck section 1. Suitable recesses on the surface of the base deck section 1 match the side edges of the gussets of the upper-tier deck section. The overcenter latch is 56 released, and the legs 6 dropped atop the stack. The configuration of FIGS. 7 and 2 is achieved.

When chosen, the cycle of shipping system erection, transport of loads, stowage, and transport of shipping systems alone may begin again.

Referring to FIG. 13, a second preferred embodiment of the invention is also a shipping system, 10'. Scanning across FIGS. 13-17, and referring back to FIGS. 2 and 7, the shipping system may be in an upper-tier raised configuration as in FIGS. 13-16, an upper-tier lowered, "stowed" or collapsed configuration similar to that of the first preferred embodiment in FIGS. 2 and 7, and a variety of configurations between these configurations, as in FIG. 17. In the raised configuration, the shipping system 10' is typically in outgoing shipping condition, with a load (not shown) on the base or lower deck section 1', and a load (not shown) on the upper-tier deck section 2'. In the collapsed configuration, the shipping system 10' is typically in inbound or return shipping condition, stacked with other similar shipping systems 10', and with no load on the pallet sections. The shipping system 10', consistently, may be loaded, lifted by forklift (not shown), placed on a vehicle (not shown), transported, stored as needed, unloaded, collapsed, and returned for further shipment. Of course, the shipping system 10' as with system 10, may be shipped loaded or unloaded without necessity of immediate return to place of origin after first shipment.

In addition to the base deck section 1' and the upper-tier section 2', the shipping system 10 comprises three pivot rods 12', 14', 16' and legs 5', 6' in pairs, at each end of pivot rods 12', 14', 16'. The rods 12', 14', 16' are generally parallel to each other, and spaced about the shipping system 10', at one edge of the base deck section 1' (rod 12'), just below the plane of the upper-tier deck section 2' and generally above the rod 12' (rod 14'), and just below the plane of the upper-tier deck section 2 and opposite the rod 12' (rod 16'). The pivot rods 12', 14', 16' provide for pivoting of the legs 5', upper-tier deck section 2', and legs 6', as will be explained.

In the raised or erected configuration of FIG. 13, the shipping system 10' generally defines a cube, unlike conventional pallets which generally always define a plane. The cube of the shipping system 10' wraps a load, whereas a conventional pallet simply underlies a load. Referring to FIG. 13 for elements 1', 2', 5' and 6', as with the first embodiment 10, the shipping system 10 wraps a load in that the base deck section 1' underlies the load, legs 5' lie along one side of the load, upper-tier deck section 2' overlies the load, and legs 6' lie along another side of the load opposite the legs 5'. Legs 5' and pivot rods 12', 14' define one end face 18' of the system cube. Legs 6' and pivot 16', along with the upper outer edge of the base deck section 1' define a second, opposite end face 20'. Similar side faces 22', 24', are formed by the structures of the shipping system 10', as are upper and lower faces formed by the structures 1' and 2'.

The base deck section 1' is substantially square, and formed in the third dimension, top and bottom, to form a sectioned load supporting deck 30'. On the top face the shipping system is sectioned by indentations. On the bottom face the base deck section is additionally formed to have several feet such as foot 32" for supporting the whole of the system 10' and providing four sided forklift access. The base deck section 1' is plastic, with horizontal steel rod supports incorporated.

The upper-tier deck section 2' defines a second load supporting deck 34' for another load (not shown). The second deck 34' is formed by crossrails and plates such as rail 36' and plate 38', as well as corner and side gussets. The gussets include lips along the outside edges for the second deck 34', for contacting and holding a load against side to side and end to end slippage.

Referring primarily to FIG. 17, shipping systems 10' may be manipulated by hand from a collapsed configuration and condition similar to FIG. 7 through a loaded configuration and condition as in FIG. 13. First, the collapsed shipping system 10' may have the upper-tier deck section 2'moved and pivoted in the direction of arrow 42' from the configuration like FIG. 7, around the pivot 12', to a configuration like that of FIG. 7. The configuration and condition is one of the upper-tier deck section 2' being folded back. Next, and different than with system 10, the legs 6' and rod 16' form a leg-rod unit 6'-16', and rotate about a pivot axis 17' formed by another pivot rod or pivot pins between the lower-tier deck section 1' and the legs 6'. Consistent with this configuration, the leg-rod unit 6'-16' is lifted and rotated from being adjacent the lower-tier deck section 1' about the pivot axis 17' to the position of FIG. 17, in the direction of arrow 43'. With the load not yet in place, the upper-tier deck section 2' may be swung upward in the direction of the upward pointing end of the arrow 51' in FIG. 17, to move toward the position of FIG. 17. The leg-rod unit 6'-16' is then pulled under the upper tier deck section 2' to support the section 2'. Over center latches at all four corners of upper tier deck section 2' are opened and latched, to keep the legs 5' and 6' fixed in relation to the upper-tier deck section 2'.

As with system 10, the load may be assembled of cartons by hand on a pallet on the shipping system 10', or moved in by forklift as in the direction of arrow 44 in FIG. 7.

At the completion of erection and loading of the shipping system 10', and as with system 10 as shown in FIGS. 1 and 12, the legs 5', 6' and upper-tier deck section 2' encircle the load over the base deck section 1'. The legs 5', 6' and upper-tier deck section 2' protect the load, as well. The legs 5' and 6' are essentially upright, i.e., vertical.

As with system 10 and its loads X and if desired Y, with system 10', loads may be transported and offloaded from the shipping system 10'.

Also as with system 10 and its FIG. 2, when the loads are removed, numerous shipping systems 10' may be stacked.

The lowest-most shipping system 10' constitutes a pallet for all the above-stacked shipping systems 10', such that the stack may be lifted and transported as a load itself. For stacking, the shipping system 10' has the leg-rod unit 6'-16' dropped on the base deck section l', rotating about the pivot axis 17'. The upper-tier deck section 2' is folded against the legs 5' about the pivot rod 14', and both the deck section 2' and the legs 5' are brought to rest with the deck section 2' upside down, i.e., inverted, over the base deck section 1'. Suitable recesses on the surface of the base deck section 1' match the legs 5', 6' and upper tier deck section 2' for compactness.

When chosen, the cycle of shipping system erection, transport of loads, stowage, and transport of shipping systems alone may begin again.

Figure 18:
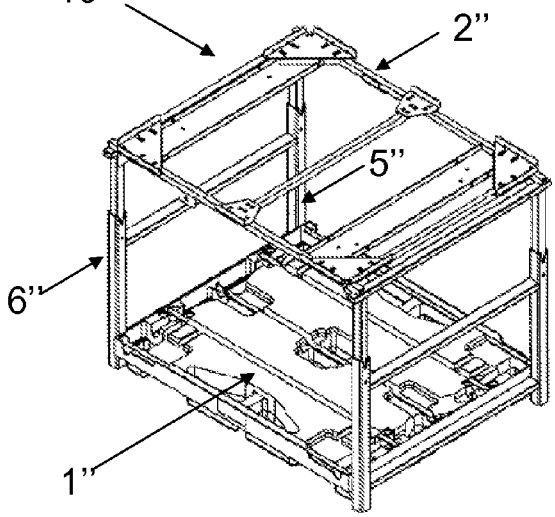

Referring to FIG. 18, a third preferred embodiment of the invention is also a shipping system, 10". Scanning across FIGS. 18-21, and comparing them to FIGS. 2 and 7, the shipping system 10" may be in an upper-tier raised configuration as in phantom in FIGS. 19-20, an upper-tier lowered, "stowed" or "collapsed" configuration similar to that of the first preferred embodiment in FIGS. 2 and 7, but as shown in solid lines in FIGS. 19-20, and a variety of configurations between the positions shown in phantom and solid line in FIGS. 19-20. Thus, the system 10" is a linear, as opposed to pivoting, system of movement between the raised and lowered positions. In the raised configuration, the shipping system 10" is typically in outgoing shipping condition, with a load (not shown) on the base or lower deck section 1", and a load (not shown) on the upper-tier deck section 2". In the collapsed configuration, the shipping system 10" is typically in inbound or return shipping condition, stacked with other similar shipping systems 10", and with no load on the pallet sections. The shipping system 10", consistently, may be loaded, lifted by forklift (not shown), placed on a vehicle (not shown), transported, stored as needed, unloaded, collapsed, and returned for further shipment. Of course, the shipping system 10" as with the systems 10 and 10', may be shipped loaded or unloaded without necessity of immediate return to place of origin after first shipment.

In addition to the base deck section 1" and the upper-tier section 2", the shipping system 10 deletes pivot rods such as 12, 14, 16 and 12', 14', 16' in favor of fixed attachment of legs 5", 6" to the deck sections 1" and 2". The legs 5", 6" are formed in two parts, upper leg sections 105, 106 and lower leg sections 115, 116. The sections 105, 106, 115 and 116 include matching pin openings such as the one marked 111 by example, at equally spaced intervals. A V-slot such as the one marked 113 is formed atop each lower leg section 115, 116. Pins (not shown) are placed in the matching pin openings at the V-slots and immediately below the V-slots as well. The pins fix the vertical distance between the upper-tier deck section 2' and the base deck section 1'. With multiple pin openings in the upper leg sections 105, 106, the vertical distance is adjustable with removal and relocation of the pins.

Figure 20:
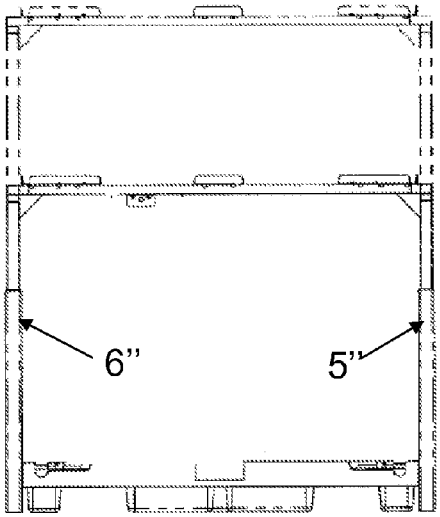
Figure 19:
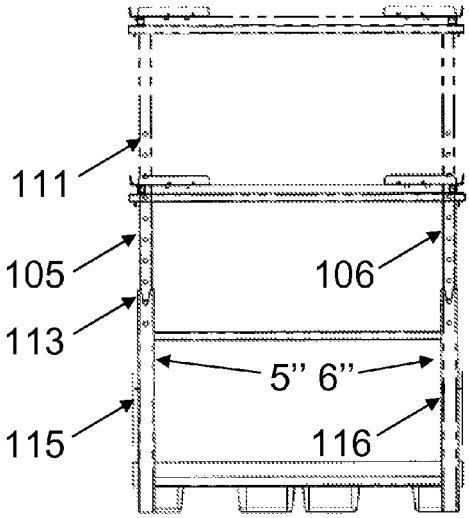
Figure 22:
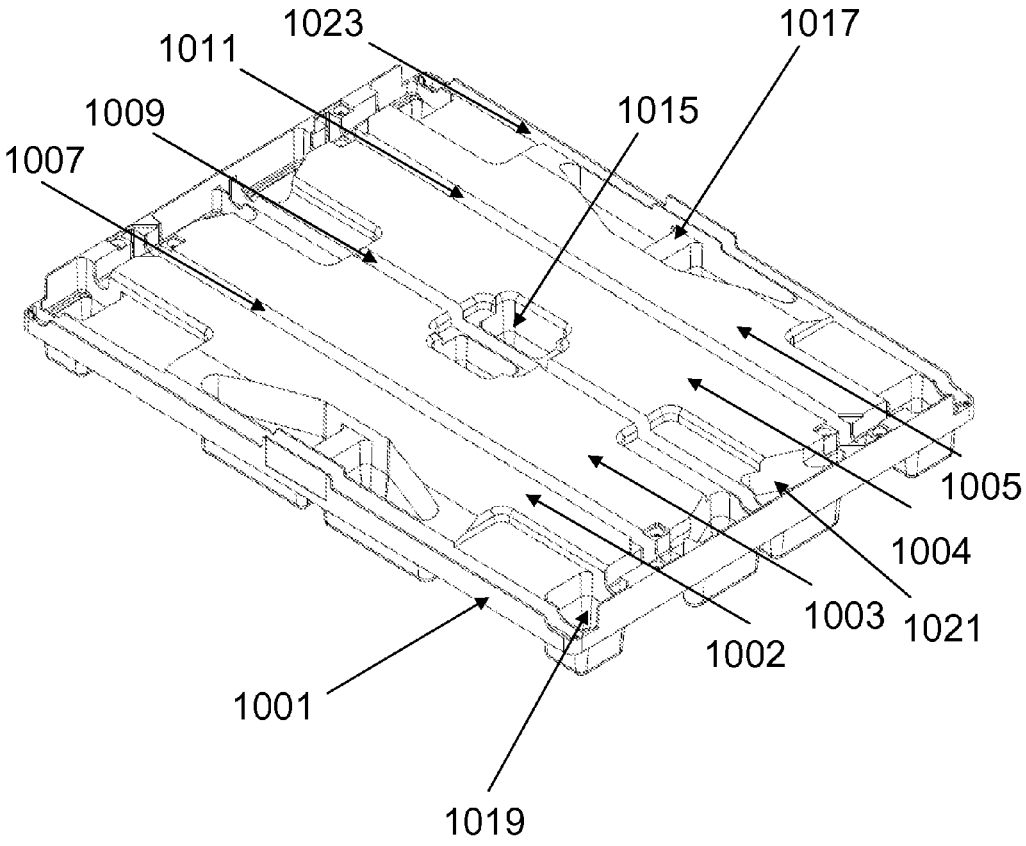

As with the systems 10 and 10', in the raised or erected configuration, in phantom in FIGS. 19-20, the shipping system 10" generally defines a cube, unlike conventional pallets which generally always define a plane. The cube of the shipping system 10" also wraps a load. Legs 5' and parts of the deck sections 1", 2" define end faces of the system cube. Similar side faces are formed by the structures of the shipping system 10", as are upper and lower faces formed by the deck sections 1" and 2".

Referring to FIGS. 22-30, a specifically preferred base deck section is designated 1001. Base deck section 1001 forms a planar upper surface in multiple (four) segments 1002, 1003, 1004 and 1005. Each segment 1002-1005 is elongated in the direction of the length of the base deck section 1001, relative to the width of each segment 1002-1005 in the transverse direction. Segments 1002 and 1005 are mirror images of each other, as are segments 1003 and 1004. Recesses, to be described, interrupt the planar upper surface, and thereby cause the segments 1002-1005 to have shapes other than rectangular.

Elongated longitudinal channels 1007, 1009 and 1011 as in FIG. 27 especially also join the segments. At the slot ends, plates at multiple (four) locations such as 1013 in FIG. 29 are bolted across the outer slots 1007, 1011, for further rigidity.

Central recess element 1015, (two) centered side recess elements such as 1017, (four) corner recess elements such as 1019 and (four) end recess elements such as 1021 extend below the planar upper surface of the section 1001 and form both feet for the section 1001 and slots for fork lift forks. Forks may pick the deck section 1001 up from either side and either end. The central recess element 1015 is substantially rectangular and square, as are the corner recess elements such as 1019. The end recess elements such as 1021 are also substantially rectangular, while the side recess elements such as 1017 take the form of swept-wing recesses intersected by a transverse truss or hump, when seen from above. Adjacent each corner recess element such as 1019, a subplanar element is rectangular, and has an elevation nearer the planar upper surface than the bottom of the corner recess element. Adjacent each end recess element, another subplanar element is formed, and abbreviated subplanar elements are adjacent each end of the central recess element 1015. Outer side channels such as 1023 receive steel elements along the sides of the section 1001 that join the end elements of the associated legs, as in the third preferred embodiment. Outer end, transverse slot elements such as 1025 provide for pivot rods such as 12 in the first preferred embodiment.

I claim:

1. A shipping system comprising:

a base deck section forming a load supporting deck;

an upper-tier deck section forming a second load supporting deck;

legs; and pivot rods;

the pivot rods connected to the legs and deck sections, and the pivot rods providing for pivoting the legs and upper-tier deck section about the base deck section, in a range of positions;

whereby through pivoting of the legs and upper-tier deck section, the shipping system may be moved through configurations including a collapsed configuration, a folded back and load-ready configuration, and an upper-tier raised configuration, the collapsed configuration for stowing, the folded back and load-ready configuration for receiving a load on the base deck section, and the upper-tier raised configuration for outgoing shipping with one or more loads in place in which the base deck section is formed to allow a second improved shipping system to be nested on top of the first for ease of shipping when the first is in a collapsed configuration, and a third shipping system to be nested atop the second, and so forth.

2. The shipping system of claim 1, the pivot rods, legs and upper-tier deck section providing movement of the upper-tier deck section through the configurations including the collapsed configuration, the folded back and load-ready configuration, and the upper-tier raised configuration, the collapsed configuration for stowing, the folded back and load-ready configuration for receiving a load on the base deck section and the upper-tier raised configuration for outgoing shipping with one or more loads in place.

3. The shipping system of claim 1, the pivot rods, legs and upper-tier deck section providing movement of the upper-tier deck section from the folded back and load-ready configuration to the upper-tier raised configuration by movement around a load received on the base deck section.

4. The shipping system of claim 1 where the upper-tier deck section is capable of being moved into a range of positions including directly atop the base deck section through a position out of the way of loading and unloading of the base deck section.

5. The shipping system of claim 1 where the base deck section is formed to allow a forklift to move the loaded or unloaded shipping system.

6. The shipping system of claim 5 where the base deck section is formed to allow forklift access on all sides.

7. The shipping system of claim 1 where the shipping system is adapted to be moved while the shipping system is loaded or unloaded.

8. The shipping system of claim 1 having a cross beam in the plane of the upper-tier deck section and supporting the upper-tier deck section.

9. The shipping system of claim 1 where the upper-tier deck section has gussets with side edges and the base deck section has recesses that match the side edges to allow the upper-tier deck section to be collapsed below the surface of the base deck section.

10. The shipping system of claim 1 where horizontal rod supports are incorporated into the base deck section to increase the strength of the base deck section.

11. The shipping system of claim 1 where the base deck section and upper-tier deck section are sized and formed to each receive a loaded shipping pallet.

12. The shipping system of claim 1 where the base deck section is sized and formed to be hand loaded with a load or loads without the use of a pallet.

13. The shipping system of claim 1 where the upper-tier deck section is sized and formed to be hand loaded with a load or loads without the use of a pallet, but with the use of an insert.

14. The shipping system comprising:

a base deck section forming a load supporting deck;

an upper-tier deck section forming a second load supporting deck;

legs; and pivot rods;

the pivot rods connected to the legs and deck sections, and the pivot rods providing for pivoting the legs and upper-tier deck section about the base deck section, in a range of positions;

whereby through pivoting of the legs and upper-tier deck section, the shipping system may be moved through configurations including a collapsed configuration, a folded back and load-ready configuration, and an upper-tier raised configuration, the collapsed configuration for stowing, the folded back and load-ready configuration for receiving a load on the base deck section, and the upper-tier raised configuration for outgoing shipping with one or more loads in place where two of the legs are detachable from the base deck section and two of the legs are permanently affixed to both deck sections.

15. The shipping system of claim 14 where an overcenter latch, hinged midway, attaches one detachable leg to the upper-tier, the connectors inhibiting twisting of the shipping system and forming a barrier to motion by the contents of the base deck section.

16. The shipping system of claim 14 where the upper-tier deck section has corners and the permanently affixed legs are attached to the upper-tier deck section inset off the corners to inhibit twisting of the shipping system and to form a barrier to motion by the contents of the base deck section.

17. The shipping system of claim 14 where one of the permanently affixed legs is attached to the base deck section by a pivotal stop, the pivotal stop at one end set in a slide surface in the base deck section, a bumper set at the end of the slide surface, the pivotal stop, slide surface and bumper configured so as to limit the motion of the permanently affixed legs, limit twisting of the improved shipping system, and to form a barrier to motion by the contents of the base deck section.

18. An improved shipping system comprising:

a base deck section forming a load supporting deck;

an upper-tier deck section forming a second load supporting deck;

the shipping system having a collapsed configuration, upper-tier raised configuration, and a folded back and load-ready configuration, the upper-tier deck section being: positioned above the base deck section when in the collapsed configuration; positioned on the base deck section and forming the upper surface of a load-receiving space when in the upper-tier raised configuration; and positioned at least partially beyond the perimeter of the base deck section when in the folded back and load-ready configuration, the collapsed configuration for stowing, the upper-tier raised configuration for shipping with one or more loads in place, and the folded back and load-ready configuration for receiving a load on the base deck section, whereby through movement of the upper-tier deck section through the configurations the shipping system may be loaded and unloaded with one or more loads and shipped.

19. An improved shipping system comprising:

a base deck section formed so that one face of the base deck section, the top face, is a load bearing surface and so that the other face of the base deck section, the bottom face, is formed to have feet, to provide support for the load bearing face and to allow a forklift to move the shipping system from any of its sides, and to allow a second improved shipping system to be nested directly atop the first for ease of shipping, a third atop the second, and so forth;

horizontal steel rod supports incorporated into the base deck section;

first pivot rod located on the base deck section;

a first pair of legs, each substantially the same length as one side of the base deck section, one end of each leg set onto opposite ends of the first pivot rod;

a second pivot rod, attached to the opposite ends of the first pair of legs, above the first pivot rod, attached to the bottom of, and inset from an edge of:

an upper-tier deck section, substantially equal in size to the base deck section, formed by rails and plates forming a load bearing surface, and corner and side gussets, the gussets lipped along the sides for contacting and holding the load, attached at the corners formed by the rails and plates, the upper-tier deck section capable of being moved around the second pivot rod;

a third pivot rod set substantially parallel to the second pivot rod and along the opposite side of the upper-tier deck section;

a second pair of legs, one end of each leg set onto opposite ends of the third pivot rod;

two stop pads, each at the end of one of the second pair of legs, the stop pads attached to form an el-shape at the end of the second pair of legs and a surface capable of taking a share of the weight of a pallet load;

an overcenter latch having one end, a middle and an other end, attached at the one end to one of the second pair of legs, hinged in the middle and attached at the other end to the upper-tier;

a pivot stop, attached at one end to a pivot point set in one of the first pair of legs, at the other end placed in a slide surface set in the base deck section;

a bumper set to block the pivot stop and stop rotation of the first pair of legs;

and an extended lower load retention lip; whereby through pivoting of the pairs of legs and upper-tier deck section, the shipping system may be moved through configurations including a collapsed configuration for stacking and transport, a folded back and load ready configuration for receiving a load, and an upper-tier raised configuration for carrying two loads, the first pair of legs remaining attached to the base deck and upper-tier deck sections, the second pair of legs attached only to the upper-tier deck section and rest-able against the base deck section supporting the upper-tier deck section, the overcenter latch and pivotal stop prohibiting the shipping system from twisting and forming a barrier to motion by the contents of the base deck section, and the formation of the base deck section allowing a second improved shipping system to be nested on top of the first for ease of shipping when the first is in a collapsed configuration, and a third shipping system to be nested atop the second and so forth.

* * * * *